United States Patent [19]

Young

[11] Patent Number: 4,463,547

[45] Date of Patent: Aug. 7, 1984

[54] ELECTRONICALLY CONTROLLED CABLE WRAPPER

[75] Inventor: Thomas M. Young, Oakland, Calif.

[73] Assignee: The United States of America as represented by the United States Department of Energy, Washington, D.C.

[21] Appl. No.: 408,998

[22] Filed: Aug. 17, 1982

[51] Int. Cl.[3] ..... B65H 81/08

[52] U.S. Cl. ..... 57/6; 57/10; 57/13; 57/264

[58] Field of Search ..... 57/3, 6, 10, 13, 15, 57/264

[56] References Cited

U.S. PATENT DOCUMENTS

| | | | |
|---|---|---|---|
| 1,831,992 | 11/1931 | Boynton | 57/10 X |
| 2,921,427 | 1/1960 | Stark et al. | 57/15 |
| 3,000,167 | 9/1961 | Pierce | 57/3 |
| 3,063,228 | 11/1962 | Sarracino | 57/3 |
| 3,137,985 | 6/1964 | Bailey | 57/13 |
| 3,507,137 | 4/1970 | Taleff et al. | 57/10 X |

*Primary Examiner*—Donald Watkins

*Attorney, Agent, or Firm*—L. E. Carnahan; Roger S. Gaither; Michael F. Esposito

[57] ABSTRACT

A spindle assembly engages and moves along a length of cable to be wrapped with insulating tape. Reels of insulating tape are mounted on a outer rotatable spindle which revolves around the cable to dispense insulating tape. The rate of movement of the spindle assembly along the length of the cable is controlled by a stepper motor which is programmably synchronized to the rate at which rotatable spindle wraps the cable. The stepper motor drives a roller which engages the cable and moves the spindle assembly along the length of the cable as it is being wrapped. The spindle assembly is mounted at the end of an articulated arm which allows free movement of the spindle assembly and allows the spindle assembly to follow lateral movement of the cable.

14 Claims, 7 Drawing Figures

ELECTRONICALLY CONTROLLED CABLE WRAPPER

The United States Government has rights in this invention pursuant to Contract No. W-7405-ENG-48 with the United States Department of Energy.

BACKGROUND OF THE INVENTION

1. Field of the Invention

This invention relates to automatic cable wrapping equipment and, more particularly, to cable wrapping equipment in which a spindle assembly carrying the wrapping material moves along the length of the cable as the cable is being wrapped.

2. Prior Art

Winding of magnet structures with super-conducting conductors, or cables, has heretofore required preliminary preparation of the superconductor cable prior to the actual magnet winding operation. The superconductive material is wrapped in a helical pattern with one or more tapes of thin plastic insulating material, such as that provided under the tradenames Mylar or Kapton. The wrapped, insulated cable is then stored on reels until needed for use with a magnet winding machine. One disadvantage of this method is that the bare cable and the wrapped cable are handled several times prior to actual winding of a magnet which increases opportunities for damage to either the cable or to the wrapped cable. Scuffing and entrapment of metal chips might cause short circuits between the turns of a coil wound with the cable. Entrapment of dirt changes the dielectric characteristic of the cable.

One prior art method of winding super-conductive cable with insulating tapes involves drawing the cable through a modified lathe using a capstan driven by a lead screw connected to the lathe gear train. Spools of insulating tape are mounted on a winding head which replaces the conventional lathe chuck. The rotation of the winding head and the turning of the capstan are controlled by the lathe gear train. The capstan allows the cable to slip. This method works with continuous feeding of cable, but is not suitable for intermittent winding functions, such as required for "on demand" operation in which the cable is wrapped just before being wound into a magnet structure. During the frequent stopping and starting required by this type of operation, the inertia of the lathe gear train and the chuck drive causes tangling and jamming of the tape, even though a detector may be provided which senses that the cable is being twisted and turns off the drive motor and applies a brake.

A number of machines are known in the prior art which use a head, or spindle, rotating around the conductor, for winding insulating tapes around a conductor. Almost all of these prior art techniques fix the position of the rotating spindle such that it remains stationary with respect to the cable moving through a machine from a supply reel to a takeup reel. An example of this type of machine is shown in U.S. Pat. No. 1,204,342, granted Nov. 7, 1916.

Some prior art tape winding machines have spindles which travel along the length of a cable being wrapped. U.S. Pat. No. 4,249,704 granted Feb. 10, 1981 shows a machine for automatically winding a fixed object such as a curved bus bar or the like. A rotating spindle is moved along the length of the object to be taped under control of a digital computer, in which is stored the cooordinates of a multiplicity of points describing the central axis of the object. This machine requires entry and storage of the coordinates for the object to be taped and uses previously stored information, rather than the object itself, to guide and control the winding spindle. The object to be wound is stationary and no provisions are made for movement or displacement of the object being wound, such as would be produced, for example, during the actual winding of a magnet structure. No provisions are made for the horizontal and vertical movement of a cable as a magnet is being wound with a cable fed from a supply reel or the like.

U.S. Pat. No. 3,940,073 granted Feb. 24, 1976 discloses apparatus for wrapping compound-curved conductor bars. The winding head carries sensors for measuring the change of position of the winding head with respect to the conductor bar. Correctional signals proportional to the relative position between the winding head and the conductor bar are provided to maintain the winding head perpendicular to the center line of the conductor bar.

SUMMARY OF THE INVENTION

It is an object of this invention to provide a cable winding apparatus which is adapted to wrapping a cable as the cable is being formed into a magnet structure.

It is another object of the invention to provide cable wrapping apparatus which is adapted to automatic intermittent wrapping operation as the cable is utilized at varying feedrates.

It is another object of the invention to provide cable wrapping apparatus which accommodates a range of cable feed-rates and cable sizes.

It is another object of the invention to provide cable wrapping apparatus which is relatively small, lightweight, and easy to assemble.

It is another object of the invention to provide cable wrapping apparatus which is adapted to intermittent wrapping operation.

The apparatus is provided according to the invention for controlling the wrapping of a cable which is moving from a supply to a utilization point, such as a magnet winding machine. A spindle assembly moves along the length of the cable to dispense wrapping material. An outer rotatable spindle portion of the assembly is rotatably mounted to an inner stationary spindle portion through which the cable passes. Means for moving the spindle assembly along the cable are provided which engage the cable. In one embodiment of the invention this means includes a stepper motor which drives a synthetic plastic roller frictionally engaging the conductor. Means are also provided for rotating the outer spindle as the spindle advances along the cable to form a wrapping around the cable. The rate of movement of the spindle assembly along the cable with respect to the rate of rotation of the spindle is synchronized to maintain a programmed ratio between the rates and thereby produce a selected one of a number of ratios corresponding to particular wrapping turns per unit length of cable. Means are provided for moveably supporting the spindle assembly, to permit the spindle assembly to freely move along the length of the cable and to move laterally to accommodate lateral movement of the cable as it is being utilized, for example, to wind a magnet. One such support means includes an articulated arm assembly which has the spindle assembly mounted at the distal end thereof.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate an embodiment of the invention and, together with the description, serve to explain the principles of the invention. In the drawings.

DETAILED DESCRIPTION OF THE PREFERRED EMBODIMENT

Reference is now made in detail to the present preferred embodiment of the invention which illustrates the best mode presently contemplated by the inventor of practicing the method and apparatus of the invention, a preferred embodiments of which is illustrated in the accompanying drawings.

Figure 1:
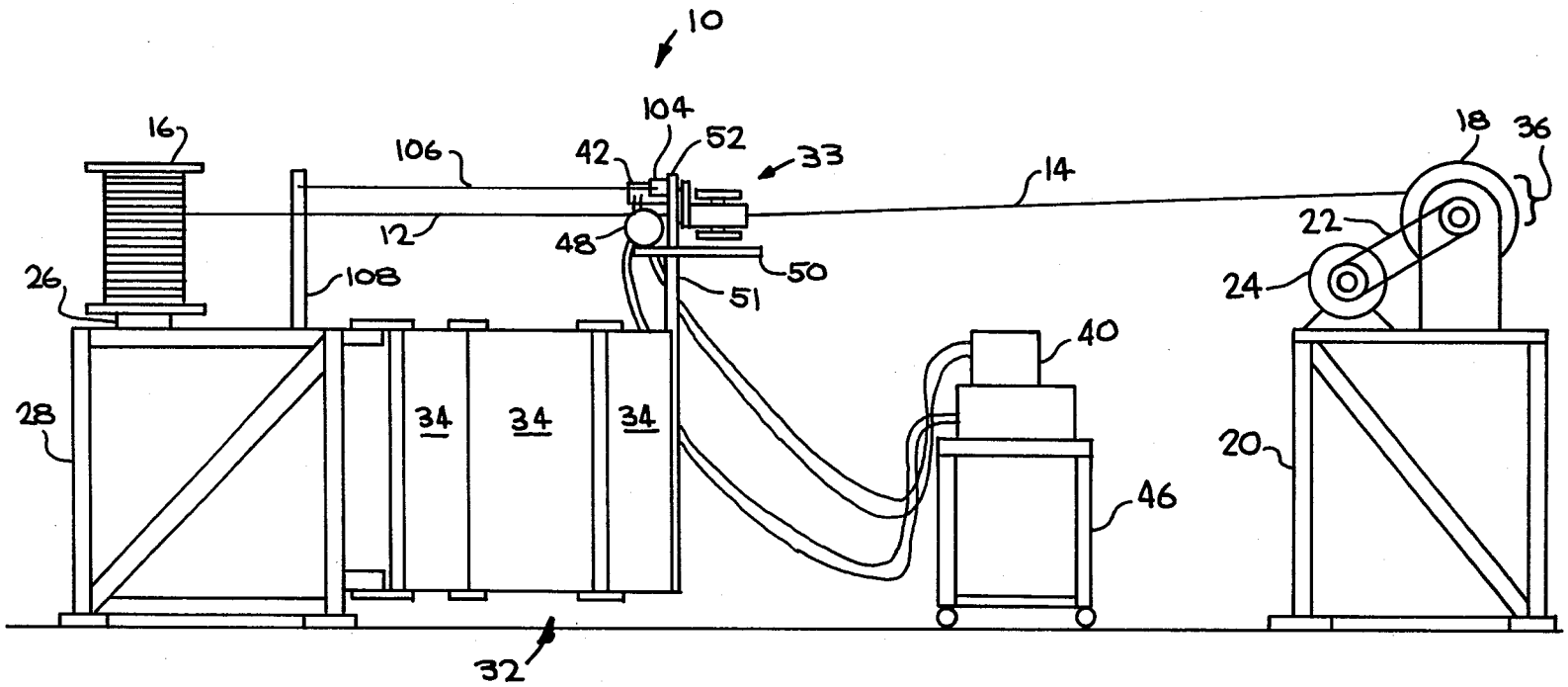
FIG. 1 is an elevational view of a magnet winding installation using a cable wrapping apparatus according to the invention.
Figure 2:
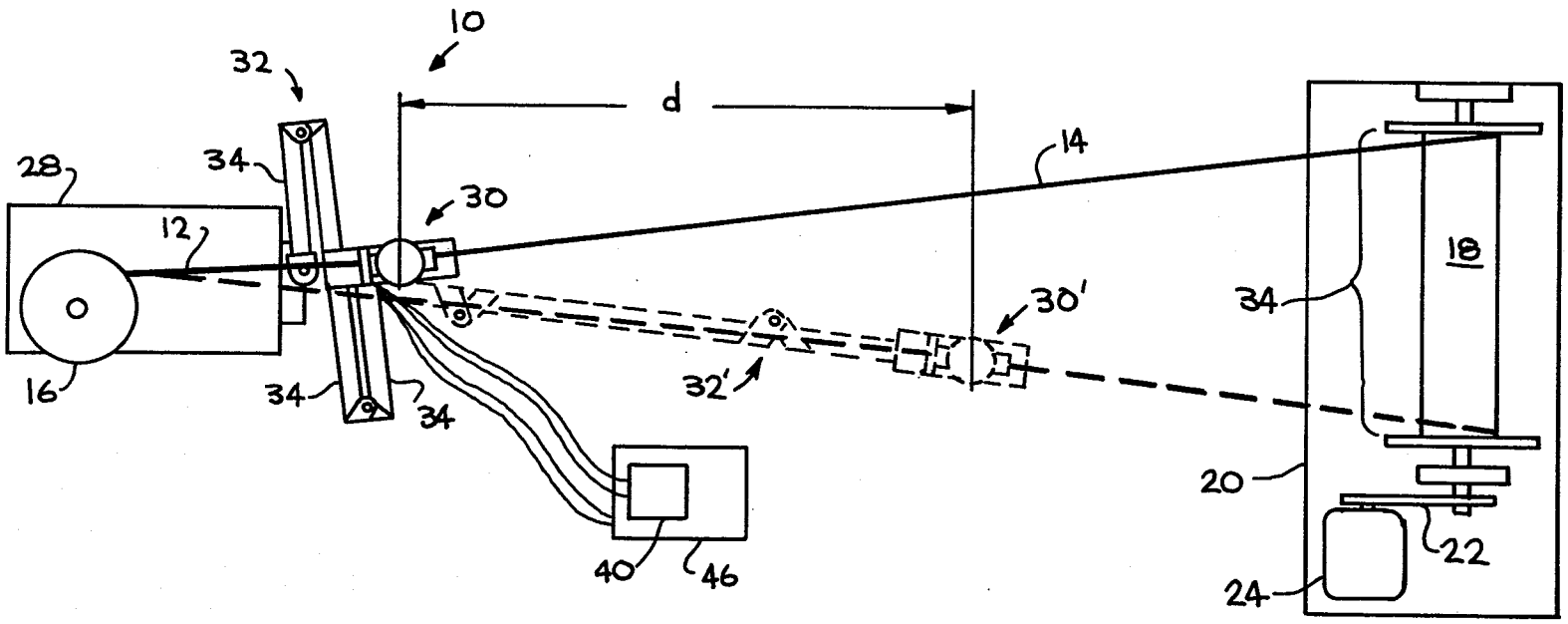
FIG. 2 is a plan view of the installation shown in FIG. 1.

Referring now to the drawings, FIGS. 1 and 2 show a typical application of the preferred embodiment of cable wrapping apparatus 10 provided according to the invention. The invention provides for control of the wrapping of insulating tape on a bare, somewhat flexible cable 12 to form a wrapped insulated cable 14. The cable 12 in the embodiment of the invention described herein has a rectangular cross section and is formed, for example, of intertwined groups of superconductive filament held in copper matrices. It will become apparent that the invention is easily adapted to accommodate the wrapping of a variety of conductors or cables having various sizes and configurations and the term cable is intended to include any such conductors or cables as well as similar items and is not to be limited only to superconductive cables of the type described herein.

This invention is particularly useful in wrapping superconductive cables because excessive handling of such cables increases the chances of scuffing and including foreign matter in the wrapped cable which might affect the superconducting characteristics thereof. So it is important that the cable be handled as little as possible. In this regard, it is very desirable that the bare cable provided on a cable spool 16 be wrapped just prior to utilization in a magnet assembly 18, shown being wound in FIGS. 1 and 2. The present invention, in fact, does allow the cable to be wrapped just prior to it being formed into the magnet assembly. The magnet assembly 18 is typically shown and is intended to be merely representative of a large variety of magnet winding machines and magnet configurations.

The bare superconductive cable 12 is fed from the cable spool 16 through the wrapping apparatus 10 to the magnet assembly 18, which has a solenoidal configuration with a plurality of concentrically wound conductor layers. While it is being wound, the magnet assembly 18 is rotatably supported on a magnet assembly support base 20 and is rotated about its axis by a belt 22 driven by a magnet winding motor 24. Constant tension on the bare cable 12 and the wrapped cable 14 is provided by a constant tension mechanism 26 coupled between the cable spool 14 and a support frame 28. The magnet winding motor 24 is typically a variable speed motor which is controlled by an operator who may stop, start, or run the motor very slowly as the magnet coil is being wound. Thus, the rate of movement of the cable along its length varies depending upon the operator's requirements and the particular cable adjustment or placement being undertaken.

The wrapping apparatus 10 includes a spindle assembly 30 mounted at the distal end of an articulated arm assembly 32, which is a particular embodiment of a means for moveably supporting the spindle assembly 30 to permit free movement of the spindle assembly along the length of the cable. The proximate end of the arm assembly 32 is pivotally attached to the support frame 28. The articulated arm assembly 32 is extended by folding and unfolding of a plurality of hinged segments 34. The articulated arm assembly 32 also allows movement of the spindle assembly 30 laterally. This permits the spindle assembly 30 to be guided by the cable to accommodate lateral movement of the cable required for forming the magnet assembly 18. Observation of FIG. 1 shows that the end of the wrapped cable moves over a range of vertical positions corresponding to the thickness 36 of the coil layer for the magnet assembly 18. Observation of FIG. 2 shows that the end of the wrapped cable 14 moves over a range of horizontal positions corresponding to the length 34 of the magnet assembly 18. In this preferred embodiment of the invention shown in the drawings the lateral motion of the cable which is accommodated by the arm assembly 32 is the horizontal motion of the wrapped cable 14 as it moves across the length 34 of the magnet assembly 18.

FIGS. 1 and 2 show a wrapping motor control console 40 connected to a wrapping motor 42 mounted on the wrapping apparatus 10. Also shown is a spindle movement motor control and synchronization console 46 connected to a spindle movement motor 48 also mounted on the wrapping apparatus 10.

The spindle movement motor 48 is part of a means, engaging the cable, for moving the spindle assembly 30 along the length of the cable. FIG. 2 shows the spindle assembly 30 in a retracted position with the segments 34 of the articulated arm assembly 32 folded together. FIG. 2 also shows the spindle assembly 30′ in phantom in a fully extended position with the hinged segments of the articulated arm assembly 32′ being fully extended. The spindle assembly can thus move along the cable a distance approximated by d, as indicated in FIG. 2.

THE SPINDLE ASSEMBLY

Figure 3:
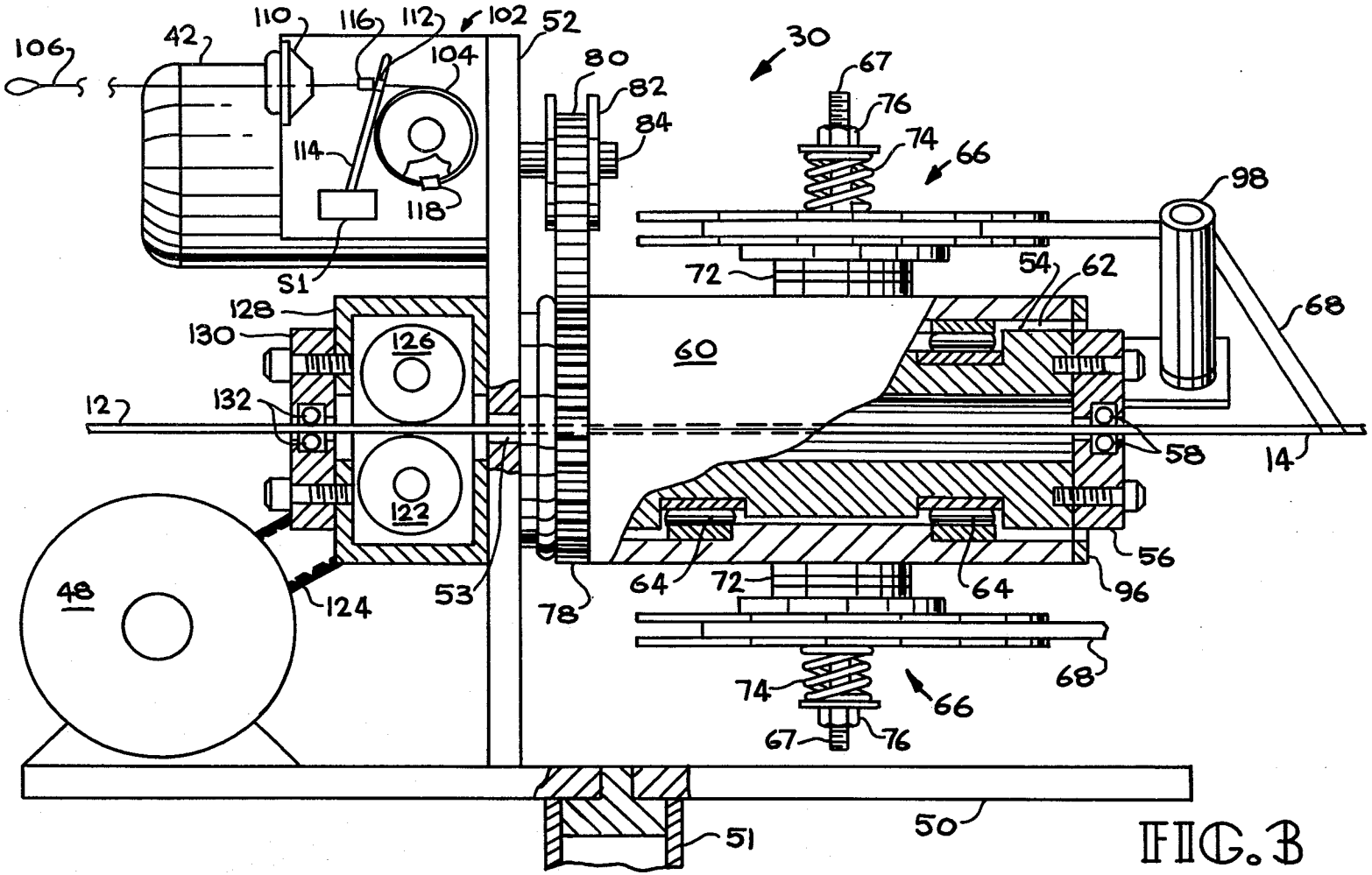
FIG. 3 is a partially sectional elevation view of a cable wrapping apparatus according to the invention.
Figure 4:
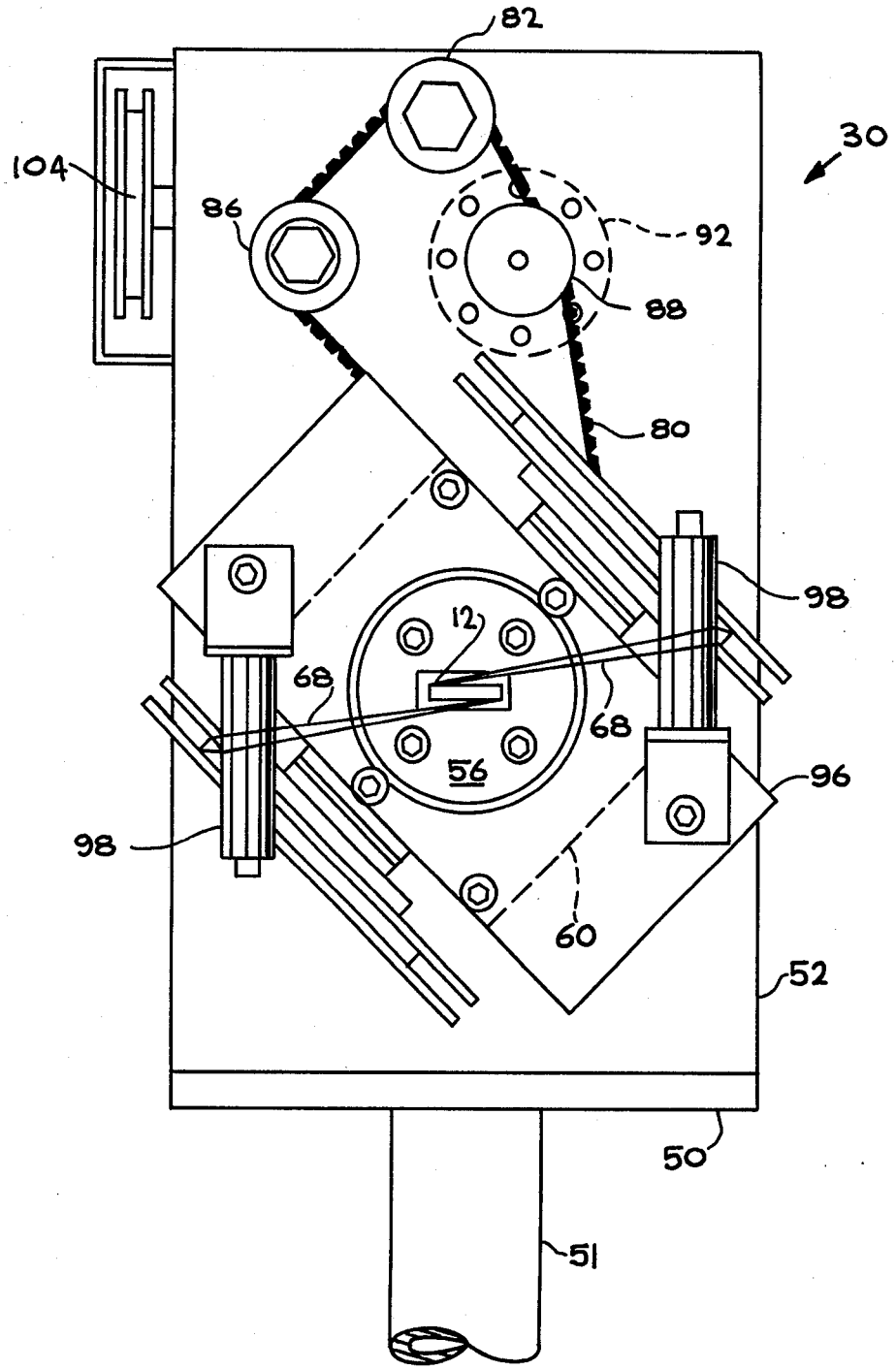
FIG. 4 is a plan view of the cable wrapping apparatus shown in FIG. 3.

FIGS. 3 and 4 show the spindle assembly 30 in greater detail. A horizontal plate 50 is pivotably fixed to the top end of a vertical support post 51, which extends upwardly from the distal end of the articulated arm assembly 32. A vertical support plate 52 is mounted at right angles to the horizontal plate 50.

The spindle assembly 30 also includes an inner stationary spindle 54 fixed to and extending substantially horizontally from the vertical plate 52. The stationary spindle 54 is a hollow cylindrical piece having a bore which is formed along its axis and through which the bare cable 12 passes. At the far end of the stationary spindle 54 is fixed a guide roller mounting plate 56 within which are mounted a pair of cable guide rollers 58 for the cable 12.

An outer rotatable spindle 60 has a cylindrical bore 62 formed therein through which extends the inner stationary spindle 54. The outer rotatable spindle 60 is mounted on two split roller bearings 64 positioned as shown in FIG. 3. Mounted to opposite exterior faces of the outer rotatable spindle 60 are two tape, or ribbon, spool assemblies 66 each of which is mounted on a stud 67 and each of which serves as a means for storing wrapping material, in this case thin insulating tapes 68 of Mylar or Kapton, or similar commercially available material. Tension for the tapes 68 is provided by friction plates 72 loaded by springs 74, the tension of which is adjusted by adjustment nuts 76 threaded on the ends of the studs 67.

The outer rotatable cylinder 60 has an external cylindrical portion 78 with external teeth formed in the surface thereof for engagement with a timing belt 80. The timing belt 80 is driven by a drive pulley 82 fixed to the end of the output shaft 84 of the wrapping motor 42 mounted on the vertical support plate 52. The timing belt 80 passes over idler pulleys 86 and drives a driven pulley 88 fixed to the input shaft 90 of a position encoder 92, which produces output electrical pulses at a rate proportional to the speed of the shaft 90. The encoder 92 serves as a means for sensing the rate of rotation of the outer rotatable spindle 60. Mounted at the far end of the rotatable outer spindle 60 is a mounting plate 96 for tape guide rollers 98 adjustably mounted for rotation thereupon.

The wrapping motor 42 is a dc motor and provides a means for rotating the outer rotatable spindel 60 to wrap the cable 12 with wrapping material such as the tape 68. The motor 42 is started and stopped by a two position toggle switch 51 which functions as a limit switch means. A limit switch assembly 102 includes the toggle switch 51 and a constant tension device 104 for a wire 106 which is shown in FIG. 1 extending from the spindle assembly 30 to a reference post 108 on the support frame 28. The wire passes through a guide bushing 110 and a clearance hole 112 formed in the end of an elongated bat handle 114 for the switch S1. Two stops 116, 118 are fixed to the cable 106 such that the elongated handle 114 for the switch S1 is actuated by stop 118 to start the wrapping motor when the spindle assembly 30 is located farthest away from the spool 16 as shown in phanton in FIG. 2. Similarly, stop 116 halts the motor 42 when the spindle assembly 30 is located close to the spool 16.

FIG. 3 shows the spindle assembly motor 48 mounted to the support plate 50 for driving a drive roller 122 by means of a belt 124. An idler roller 126 works with the drive roller 122 to maintain engagement between the cable 12 and the drive roller 122 so that the drive roller 122 grips the cable 12. The drive roller 122 and the idler roller 126 are mounted in a housing 128 which is fixed to the vertical plate 52. Another guide roller mounting plate 130 is attached to the housing 128 for mounting another pair of cable guide rollers 132.

It has been found that the drive roller, or at least the surface thereof which engages the cable 12 is preferably made of a synthetic resin material such as that provided under the tradename Plexiglass. It appears such a material does not have its frictional characteristic affected by oil present on the surface of the cable 12 so that no slippage or sliding occurs. This is important because when the wrapping motor 42 is not operating, the spindle motor 48, which is a stepper motor, remains locked in a stationary position so that the drive roller 122 grips the cable 12 and pulls the spindle assembly 30 along with the cable. When the wrapping motor 42 is operating, the motor 48 is stepped in synchronization therewith. The drive roller 122 provides a means, engaging the cable 12, for accurately moving the spindle assembly 30 along a portion of the cable determined by the stops 116 and 118 of the limit switch assembly 102. Thus, it is important that no slippage occur between the drive roller 122 and the cable 12.

In some cases, it may be necessary to perform cable wrapping where the ends of the cable are not accessible. The spindle assembly 30 is designed such that its components can be assembled around a cable. The vertical mounting plate 52 has a horizontal slit 53 formed therein to accomodate lateral insertion of a cable. The inner stationary spindle 54, the outer rotatable spindle 60, the guide roller mounting plates 58, 130, as well as the bearings 64 are each formed of two split halves which are bolted together to form the components described herein and illustrated in the drawings.

WRAPPER MOTOR CONTROL

Figure 5:
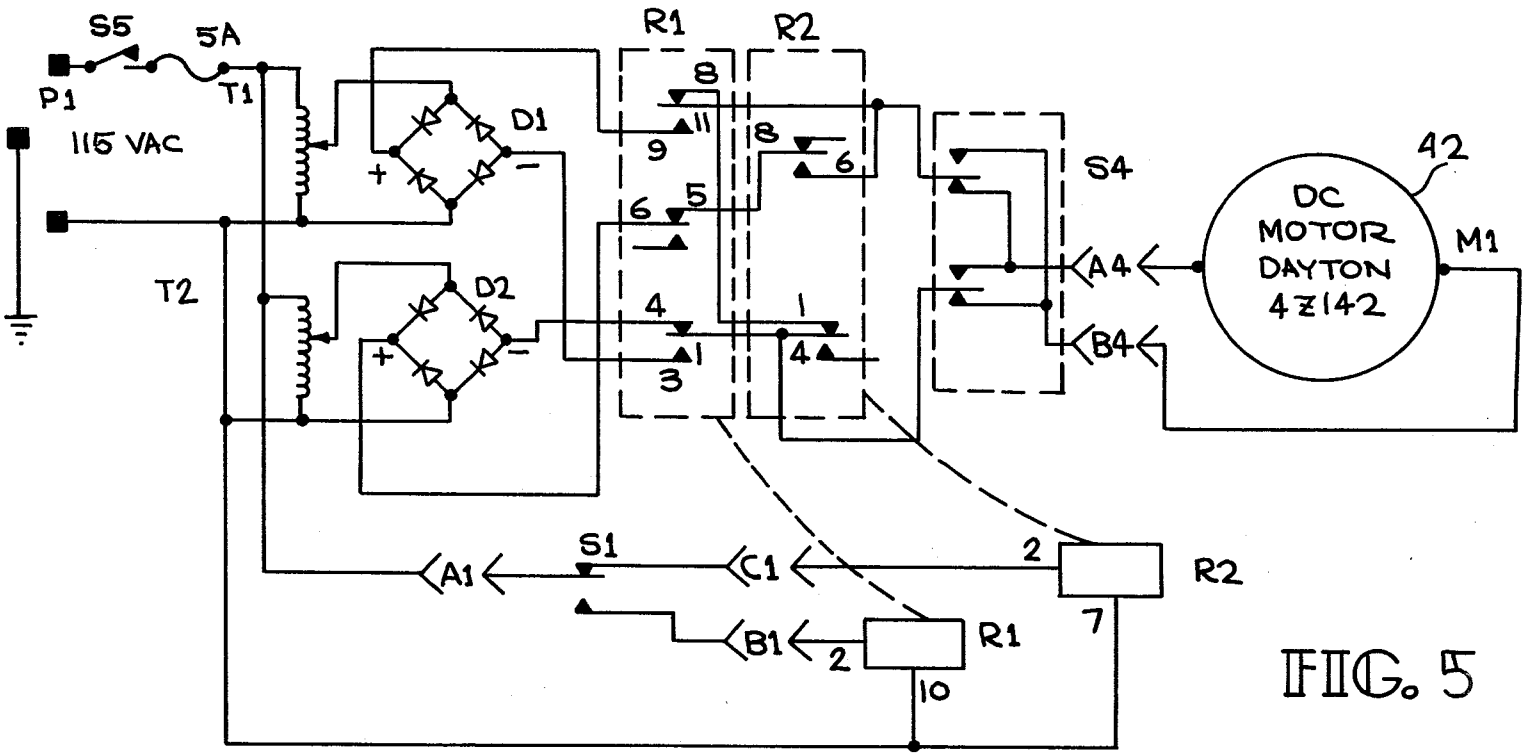
FIG. 5 is a schematic drawing of the electrical circuit for driving the rotatable spindle.

FIG. 5 is a schematic diagram for the dc wrapping motor 42. This circuit provides dc voltages to operate the wrapping motor 42 which drives the rotatable outer spindle 60 and wrap insulating tape 68 around the bare cable 12. Alternating voltage at 115 VAC is supplied from a plug P1 through a power switch S5 to variacs T1 and T2. Alternating voltage from the tap on Variac T1 is full-wave rectified by the diode assembly D1 to provide a rectified dc voltage for controlling the winding speed of the motor 42. T2 provides a voltage when the wrapping motor 42 is in an idle, or stopped, mode.

Switch S1 of FIG. 3 is the limit switch which is part of the limit switch assembly 102. When S1 is actuated by stop 118 to be in the lower position connecting A1 to B1 as shown in FIG. 5, the dc motor 42 operated to wind insulating tape 68 around the bare cable 12. A reversing switch S4 is connected to the input terminals of motor 42 and determines the direction of forward rotation of the motor, or the direction of winding of the tape along the cable 12. With S4 positioned as shown, relay R1 is actuated and, the positive terminal of the rectifier assembly D1 is connected through contacts 9 and 11 of relay R1 to terminal A4 of switch S4. Similarly, the negative terminal of the rectifier assembly D1 is connected through contacts 3 and 1 of relay R1 to terminal B4 of S2.

When S1 is actuated by stop 116 to be in the upper position connecting terminal A1 to C1 as shown in FIG. 5, relay R1 is disabled and relay R2 is enabled. Relay R2 has a delayed operation characteristic so that terminals A4 and B4 of switch S2 are momentarily shorted together through contacts 8 and 11 of relay R1 when S1 is initially placed in the upper position. This provides for fast braking of the motor 42. The positive voltage provided by the rectifier assembly D2 is set with T2 at a level below that of the rectifier assembly D1 so that the motor is idled or stalled but a small amount of tension is maintained on the tapes 68. After R2 is actuated, the positive terminal of the rectifier assembly D2 is connected through contacts 6 and 5 of relay R1 and through contacts 8 and 6 of relay R2 to terminal A4 of switch S4. Similarly, the negative terminal of the rectifier assembly D2 is connected through terminals 4 and 1 of relay R1 to terminal B4 of S4. This lower voltage is not sufficient to operate the motor 42 but, as previously mentioned keeps the tapes 68 under tension.

SYNCHRONIZER AND STEPPER MOTOR CONTROL

Figure 6:
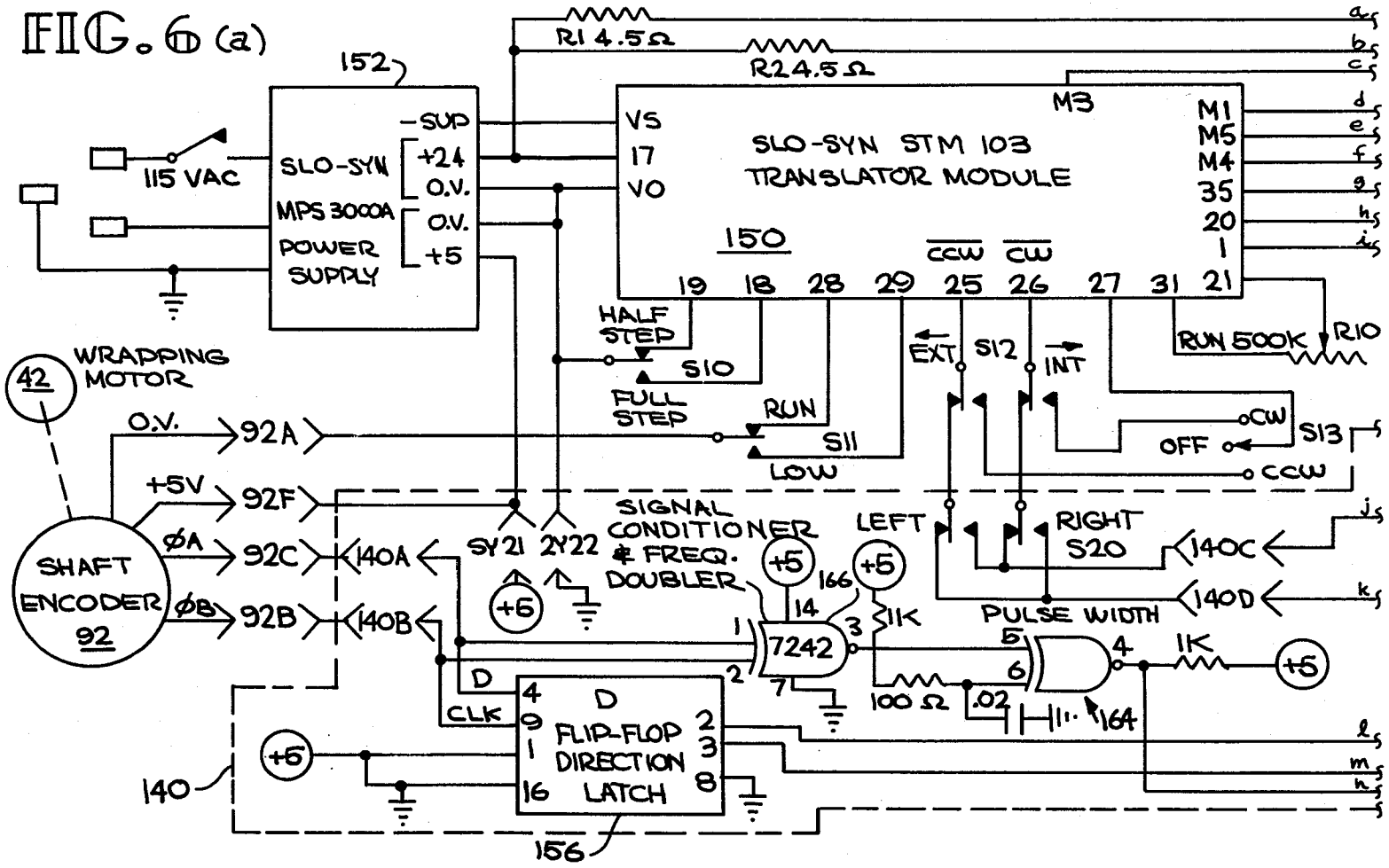
FIGS. 6(*a*) and 6(*b*) are each extended portions of a schematic drawing of the electrical circuit for synchronizing and controlling the stepper motor used to move the spindle assembly along the length of a cable being wrapped.
Figure 6:
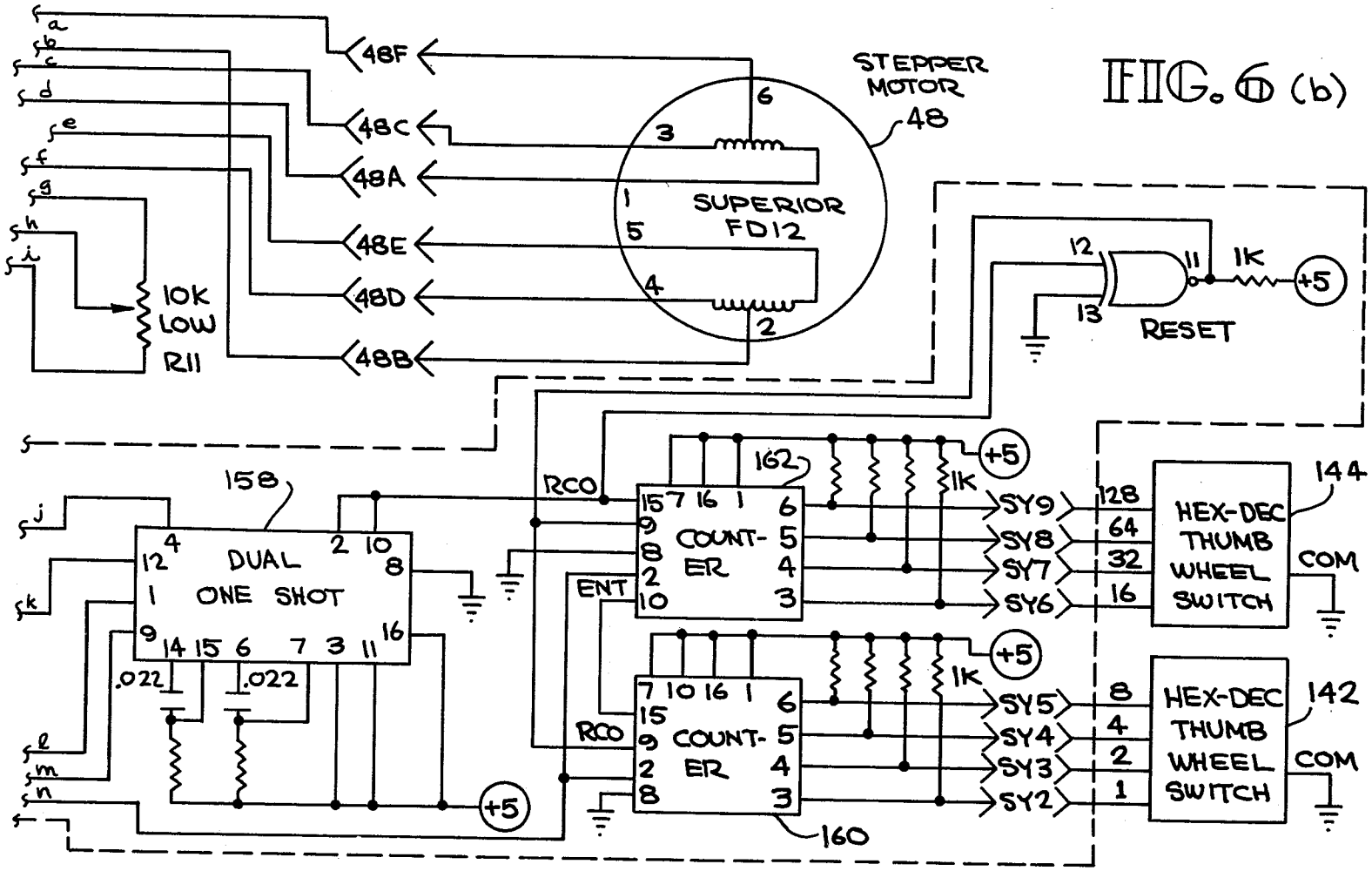

FIGS. 6(*a*) and 6(*b*) show within the dotted lines a synchronizer circuit 140 for driving the spindle assembly motor 48 in response to signals received from the position encoder 92. The synchronizer circuit 140 is a means for synchronizing the rate of movement of the spindle assembly 30 along the length of cable 12 with the rate of rotation of the outer spindle 60 to control the turns per inch of the tapes 68 on the wrapped cable 14. As previously mentioned, the shaft encoder 92, a commercially available item, senses the rate of rotation of the outer rotatable spindle 60 and provides quadrature square wave output signals on lines A and B, the rate of these signals indicating the rate at which the dc wrapping motor 42 is being driven. The relative phase of these signals indicates the direction in which the motor 42 is turning.

The synchronizer circuit 140 is programmably adjustable to vary the ratio between the speeds of the stepper motor 48 and the wrapping motor 42 and thus provide for adjustable variation of the ratio between the rate of movement of the spindle assembly 30 as it moves along the cable 12 and the rate of rotation of the outer spindle 60 as it wraps tapes 68 around the cable 12 in a helical pattern. In other words, this speed ratio controls the pitch of the insulating tape being wound. Hexadecimal thumbwheel switches 142, 144 are connected to the synchronizer ciruit 140 as shown in FIG. 6(*b*). These switches are set by an operator to provide one of 256 possible speed ratios and provide a means for programming the ratio of the rate of movement of the spindle assembly 30 along the length of cable to the rate of rotation of the outer spindle 60.

The spindle movement motor 48 is a commercial four-phase stepper motor. The phase control signals for the stepper motor 48 are supplied by a commercial translator module 150 which is provided with appropriate electrical power from a commercial power supply module 152. The operation of these modules is known to one of ordinary skill in the art and is not discussed herein. Control of the stepper motor 48 is provided by various switches: a half/full step switch S1O; a run/low speed switch S11; an external/internal step pulse switch S12; and an internal step pulse direction switch S13. Variable resistors R10 and R11 control the run and low speeds.

When switch S12 is in the external position, step pulses for the stepper motor 48 are provided by the synchronizer circuit 140 through a left/right motor direction switch S20. Each step pulse increments the stepper motor 48 a predetermined step angle. That step angle is translated by the belt 124 to the drive roller which steps an incremental distance along the cable. A series of step pulses in succession therefore move the spindle assembly 30 at a rate locked to the pulse rate of those step pulses. The step pulses at switch S20 are delivered at a rate directly proportional to the pulse rate of the output square waves ØA, ØB from the position encoder 92 connected to the wrapping motor 42.

The manner of operation of the synchronizer circuit 140 is as follows. Signals ØA and ØB are quadrature square waves, the relative phases of which depend upon the direction of rotation of the wrapping motor 42. These signals are fed into a D flip-flop direction latch 156 which provides an output signal to either of terminals 1 or 9 of a dual one-shot circuit 158 to enable one or the other of the one-shot circuits. Whichever one is selected will provide, when triggered,a step pulse on either one of the respective output terminals 4 or 12 to step the stepper motor a predetermined angle in a selected direction. The one-shots are triggered by an appropriate signal appearing on terminals 2 and 10 thereof which as fed with the output of a counter circuit using Hexadecimal counters 160–162. These are programmed by respective hexadecimal thumbwheel switches 142–144, provide a programmable means for synchronizing the ratio of the rate of movement of the spindle assembly 30 along the cable (controlled by the stepper motor 48) to the rate of rotation of the outer spindle 60 (controlled by the wrapping motor 42). Input pulses to the clock terminals 2 of the counters 160–162 are provided from the output of a pulse width control circuit which is fed from the output of a frequency-doubler exclusive-or gate 166. The exclusive-or gate 166 receives the ØA and ØB signals at its inputs and provides an output signal at twice the input rate of the quadrature input square waves.

The pulses provided by the synchronizer circuit 140 are delivered at a rate which is an integer submultiple of the square wave pulses provided by the position encoder 92, which tracks the rate of wrapping of tapes around the cable 12. By varying the settings of the hexadecimal thumbwheel switches, various wrapping ratios and tape pitches, that is, the number of turns of tape per inch of cable, can be obtained.

When the wrapping motor 42 is not operating, the drive roller does not turn and it grips the cable 12 so that the spindle assembly 30 is pulled along by the cable. In operation, the apparatus according to the invention is set up so that the spindle assembly 30 is moved without wrapping the cable from a position in which the articulated arm 32 is retracted with the spindle assembly 30 near the cable spool 16 to a position in which the articulated arm 32 is almost fully extended. The stops 118 of the limit switch assembly 102 is set so that the limit switch S1 is tripped as the articulated arm 32 extends beyond a predetermined point. This starts the wrapper motor and the tape wrapping function. When this occurs, the stepper motor is also stepped and moves the spindle assembly 30 along the length of the cable back toward the cable spool 16. The rate of movement of the spindle assembly 30 along the cable 30 is synchronized to the rate of the tape wrapping to provide a desired tape pitch on the cable. When the spindle assembly 30 travels to a position on the cable such that the stop 116 trips the limit switch S1, the wrapping motor 42 is disabled and the drive roller 122 stops movement of the spindle assembly 30 with respect to the cable. A typical length of cable wrapped in one operation is approximately six feet. The stopped drive roller grips the cable and the spindle assembly is pulled along with the cable as it is being wound into a magnet. This invention thus permits a length of cable to be wrapped upon demand, even while the wrapped cable is simultaneously being wound into a magnet assembly. The wrapping operation is automatic as described above and can easily accomodate vaiable cable speeds. The pitch of the wrapping is easily programmed to any one of a number of settings.

The foregoing description of preferred embodiments of the invention have been presented for purposes of illustration and description. They are not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto and their equivalents.

I claim:

1. Apparatus for controlling the wrapping of a cable with wrapping material, the cable being adapted to move at variable rates from a supply to a takeup or utilization point, comprising:

a spindle assembly including an inner stationary spindle having a central aperture through which the cable passes and including an outer rotatable spindle rotatably mounted to the inner stationary spindle;

means, engaging the cable, for moving the spindle assembly along a portion of the cable;

means mounted on the outer rotatable spindle for storing wrapping material;

means for rotating the outer rotatable spindle to wrap the cable with said wrapping material;

means for moveably supporting the spindle assembly to permit free movement of the spindle assembly along the length of the cable in a plane extending substantially laterally with respect to the cable such that the spindle assembly is positioned by the cable extending therethrough to accommodate lateral movement of the cable to the utilization or takeup point; and means for synchronizing the rate of movement of the spindle assembly along the length of the cable and the rate of rotation of the outer spindle.

2. The apparatus of claim 1 wherein the means for moveably supporting the spindle assembly includes an articulated arm assembly having the spindle assembly mounted at the distal end thereof.

3. The apparatus of claim 1 wherein the synchronizing means includes means for sensing the rate of rotation of the outer rotatable spindle.

4. The apparatus of claim 1 wherein the synchronizing means is adjustable to vary the ratio between the rate of movement of the spindle assembly 30 as it moves along the cable to the rate of rotation of the outer spindle 60.

5. The apparatus of claim 1 wherein the synchronizing means includes means for programming the ratio of the rate of movement of the spindle assembly along the length of cable to the rate or rotation of the outer spindle.

6. The apparatus of claim 1 wherein the means engaging to the cable for moving the spindle assembly along a portion of the cable includes a stepper motor controlled by the synchronizing means.

7. The apparatus of claim 1 including means for starting and stopping the means for rotating the outer spindle.

8. The apparatus of claim 7 wherein the means for starting and stopping includes limit switch means.

9. The apparatus of claim 8 including stops positionable to operate the limit switch means to wrap a predetermined length of cable.

10. The apparatus of claim 1 wherein the means mounted on the outer rotatable spindle for storing wrapping material includes means for applying tension to the tape.

11. The apparatus of claim 1 wherein the means for moving the spindle assembly along a portion of the cable includes a driving member which engages the cable and is controlled by the means for synchronizing the rate of movement of the spindle assembly along the length of the cable and rate of rotation of the outer spindle.

12. The apparatus of claim 11 wherein the driving member includes a roller frictionally engaging the cable.

13. The apparatus of claim 12 wherein the roller surface frictionally engaging the cable includes a synthethic resin material.

14. Apparatus for controlling the transfer of covering material with respect to a cable having a variable rate of movement towards a utilization or takeup device, comprising:

a spindle assembly through which the cable passes, said spindle assembly adapted for movement along the cable and for rotation about the cable passing therethrough;

means, mounted to the spindle assembly, for storing covering material;

means for transferring covering material between the spindle and the storage means;

means for sensing the rate at which the covering material is transferred;

means for supporting the spindle for free movement along the length of the cable and in a plane extending substantially laterally with respect to the cable; and means, engagable with the cable, for moving the spindle along the length of the cable in response to the rate at which covering material is transferred to maintain a predeterminedly selected ratio between the rate of transfer of the covering means and the rate of movement of the spindle movement along the cable.

* * * * *